United States Patent [19]

Tunströmer

[11] Patent Number: 4,693,234

[45] Date of Patent: Sep. 15, 1987

[54] APPARATUS FOR AND METHOD OF BURNING AND/OR THERMALLY DECOMPOSING FUEL, ESPECIALLY SOLID FUELS

[75] Inventor: Nils Tunströmer, Mullsjö, Sweden

[73] Assignee: Stubinen Utveckling AB, Stockholm, Sweden

[21] Appl. No.: 827,977

[22] PCT Filed: May 20, 1985

[86] PCT No.: PCT/EP85/00239

§ 371 Date: Mar. 13, 1986

§ 102(e) Date: Mar. 13, 1986

[87] PCT Pub. No.: WO85/05434

PCT Pub. Date: Dec. 5, 1985

[30] Foreign Application Priority Data

May 21, 1984 [DE] Fed. Rep. of Germany ..... 3418864

[51] Int. Cl.[4] ..... F23H 9/04

[52] U.S. Cl. ..... 126/155; 126/181

[58] Field of Search ..... 126/152 R, 155, 180, 126/181, 179, 157

[56] References Cited

U.S. PATENT DOCUMENTS 371,246 10/1887 Bostwick ..... 126/181

1,694,211 12/1928 Fernandez ..... 126/155

FOREIGN PATENT DOCUMENTS 116441 10/1899 Fed. Rep. of Germany ..... 126/181

*Primary Examiner*—James C. Yeung

*Attorney, Agent, or Firm*—Pahl, Lorusso & Loud

[57] ABSTRACT

An apparatus for and a method of burning and/or thermally decomposing fuel, especially solid fuels, including means for supplying fuel and, if applicable, means for supplying air or oxygen to a combustion site comprising a grate, preferably a bar grate. To improve and control combustion or thermal decomposition the grate has associated therewith a material loosening and/or grate cleaning means acting on the fuel and/or slag, ash or like material deposited on the grate, said means and said grate adapted for reciprocating movement relative to one another.

9 Claims, 10 Drawing Figures

Figure 1:
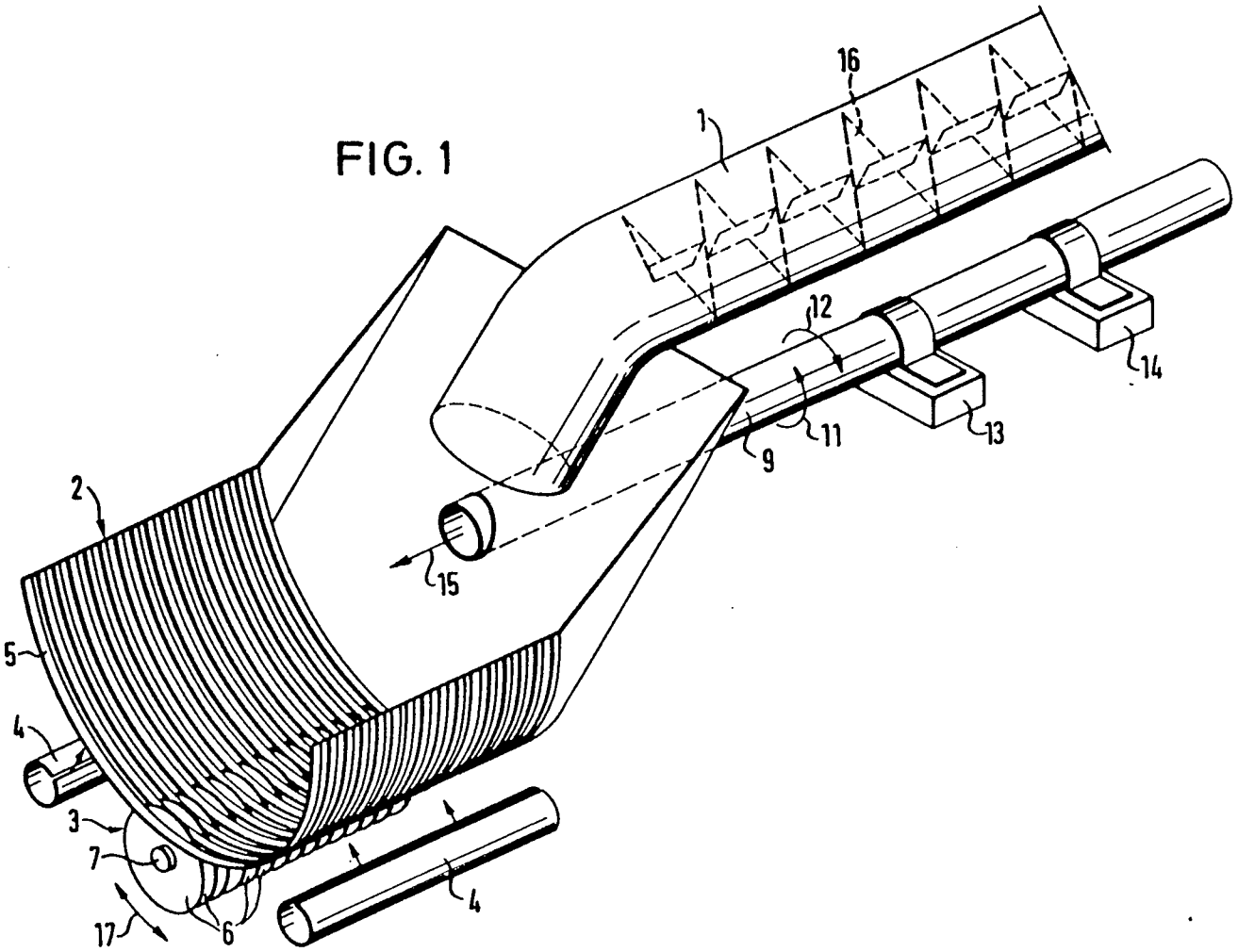

APPARATUS FOR AND METHOD OF BURNING AND/OR THERMALLY DECOMPOSING FUEL, ESPECIALLY SOLID FUELS

The invention is directed to an apparatus for burning and/or thermally decomposing fuel especially solid fuels.

When solid fuels are burned and/or thermally decomposed on a grate it is unavoidable that due to fuel and/or slag deposits or the like the grate will become clogged in the course of operation, resulting in a steadily decreasing efficiency. This problem has been recognized for decades in the case of smaller coal and/or wood-burning ovens. It is therefore necessary for maintaining combustion to free the oven or furnace grate from time to time from deposited residues of combustion or the like by means of a stoker or the like. There are also ovens or furnaces that are provided with vibratory grates. These measures cannot be employed, however, in large heating installations, and moreover they would be of little effect.

The present invention is based on the subject of providing an apparatus and a method of the above-specified kind in which undesired clogging of the grate can be reliably prevented, while at the same time good control of the combustion process or the thermal decomposition shall be achieved.

The invention ensures that the furnace grate is kept free from deposited fuel and/or slag material or the like in dependence on the preset relative movement between the grate and the loosening and/or cleaning means. There is no risk of undesired clogging or sintering of the grate due to ash, slag, non-combusted or partially combusted fuel. At the same time, the degree of combustion or thermal decomposition, respectively, can be effectively controlled in accordance with the preset degree of opening of the burning grate. The extent of relative movement between grate and loosening and/or cleaning means determines the combustion-active area of the burning grate, which correspondingly influences the degree of combustion or thermal decomposition, respectively.

Due to the measures in accordance with the invention it is also possible to considerably reduce the size of the furnace installation, because a substantially smaller burning grate as compared to burning grates of conventional furnace installations is required to achieve a comparable degree of combustion or thermal decomposition. This means that the invention can also be used to advantage for smaller furnace installations such as single-family units or multifamily buildings. The invention is especially effective for the combustion of refuse such as domestic refuse or similar hardly combustible or thermaly decomposable materials.

The invention not only provides that the grate is kept open for purposes of sufficient air supply, but at the same time the materials placed on the grate are simultaneously revolved and thus subjected to more effective combustion.

Figure 2A:
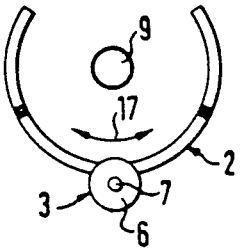
Figure 2B:
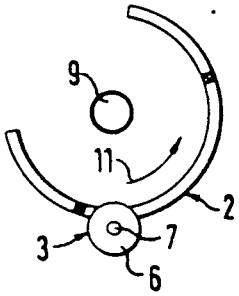
Figure 2C:
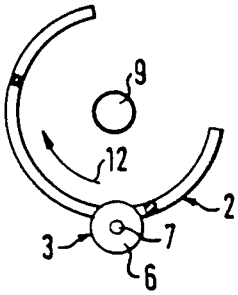
Figure 3A:
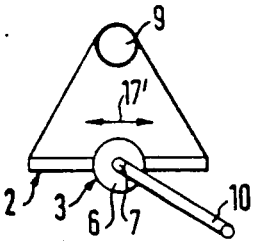
Figure 3B:
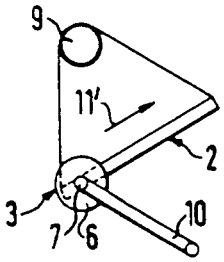
Figure 3C:
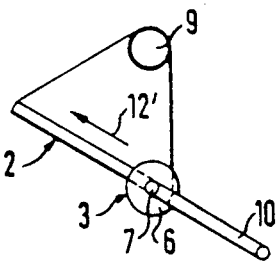
Figure 4A:
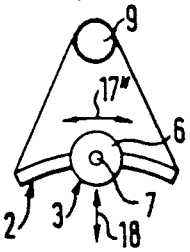
Figure 4B:
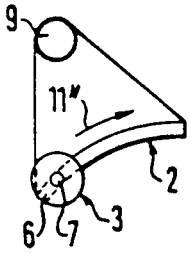
Figure 4C:
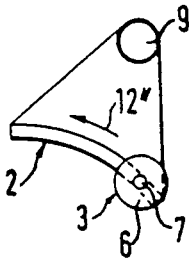

Preferred embodiments of an apparatus according to the invention shall be described in detail below with reference to the accompanying drawing, in which:

FIG. 1 is a schematic perspective view of an apparatus according to the invention, FIGS. 2*a*–2*c* illustrate the swinging grate of FIG. 1 in a schematic front view and in three different positions relative to a material loosening and grate cleaning means, FIGS. 3*a*–3*c* illustrate a front view corresponding to FIGS. 2*a*–2*c* of a further embodiment of a grate according to the invention in correlation to a material loosening and grate cleaning means, and FIGS. 4*a*–4*c* illustrate a front view corresponding to FIGS. 2*a*–2*c* and 3*a*–3*c*, respectively, of a further embodiment of a burning grate according to the invention in correlation to a material loosening and grate cleaning means.

The apparatus for burning and/or thermally decomposing especially solid fuels such as peat, coal, wood, straw or refuse as illustrated in FIG. 1 comprises a tubular fuel supply pipe 1 and a primary air supply means 4 for supplying primary air to a basket-like bar grate 2 having correspondingly curved grate bars 5. This bar grate 2 defines the site of combustion of the mentioned fuels. The primary air supply means 4 is disposed at the underside of the bar grate 2 or the side thereof opposite to the fuel supply pipe 1, and that diametrally to the upright centre plane extending through the longitudinal axis of the fuel supply pipe 1 or the swinging shaft 9 associated with the bar grate 2, which shaft will be explained below. Thus, the bar grate 2 is mounted for swinging motion about the shaft 9 and is driven thereby. The swinging motion is indicated by arrows 11 and 12 in FIG. 1. The swinging shaft 9 is disposed below the fuel supply pipe 1. The swing bearings 13, 14 are merely indicated in FIG. 1. The swinging shaft 9 is configured as a tube through which secondary air may be blown in the direction of the arrow 15 to promote combustion or thermal decomposition. In the interior of the fuel supply pipe a fuel conveying means, preferably a helical screw 16, is disposed which is merely indicated in FIG. 1. The bar grate 2 has associated therewith a material-loosening-cum-grate-cleaning means 3 which acts on the fuel and/or slag, ash and the like material deposited on the grate 2, said means 3 being in the form of disks 6 protruding between the grate bars 5 and being respectively mounted with clearance on a common support shaft 7 which extends approximately perpendicularly to the grate bars 5 and approximately parallel to the swinging shaft 9, respectively. The disks 6 are stationary relative to the swingably mounted grate 2. Thus, the schematically illustrated relative positions between the disks 6 and the means 3 and the grate 2 will result when the latter is swingably driven about the swinging shaft 9. When the grate 2 is swingably driven about the shaft 9, the disks 6 will prevent clogging or sintering of the grate due to slag, ash, non-combustibles, only partially combusted material etc. When the grate 2 is swingably driven the disks 6 ensure that a sufficient quantity of primary air reaches the material to be burned on the grate 2. Moreover, when the grate 2 is swingably driven in the direction of the arrows 11 and 12 or of the double-arrow 17, the disks 6 cause a certain amount of revolving of the material charged onto the grate 2, whereby such material is loosened. The free surface is correspondingly increased, and the combustion process is accelerated or improved. The intensity of combustion or thermal decomposition of the material fed through the pipe 1 may be controlled by the degree of swinging motion of the grate 2. The higher the swinging frequency and the swinging amplitude, the more intensive the combustion or thermal decomposition, or vice versa.

It is also possible to use instead of the disks 6 tines or the like protruding between the grate bars. The free ends thereof may be provided with turning members, e.g. turning blades, in order to improve revolving of the material to be burned when the grate 2 is swingably driven about the swinging shaft 9.

Basically, it is also conceivable that the bar grate 2 is disposed to be stationary inside the combustion space and to reciprocate instead the material loosening and grate cleaning means relative to the grate. The swinging shaft 9 is adapted to be coupled to a swinging drive means (not illustrated).

In the embodiment illustrated in FIGS. 3*a*, 3*b* and 3*c* the grate 2, which is mounted for swinging motion about the shaft 9 and is driven thereby, is of flat configuration. The shaft 7 on which the disks 6 of the means are mounted, preferably with clearance therebetween, is supported by a connecting rod 10, on the one hand, and by the grate 2, on the other hand, for longitudinal movement in the plane of the grate in the direction of the double-arrow 17', so that when the grate 2 is swingably driven in the direction of the arrows 11' and 12' it can move relative to the means 3. FIGS. 3*b* and 3*c* illustrate schematically the opposite limits of swinging motion of the grate 2 in correlation to the means 3.

Rather similar conditions prevail in the embodiment illustrated in FIGS. 4*a*, 4*b* and 4*c*. This embodiment differs from the previous one only in that the grate 2 is convexly curved as viewed from the top. Furthermore, the shaft 7 is likewise supported on the grate 2 for longitudinal movement in the direction of the double-arrow 17''. Moreover, the shaft 7 must be supported in vertical direction or in the direction of the double-arrow 18 so as not to impede the swinging motion of the grate 2 about the shaft 9 in the direction of the arrows 11'' and 12'', respectively.

Preferably, a covering is provided above the grate 2 so that a forwardly directed flame will be obtained. Of course, the entire apparatus is installed within a combustion or gasification chamber.

As will be apparent from FIGS. 1 to 4*c*, the swinging shaft 9 is respectively disposed above the plane of the grate so that swinging motions of the grate are made possible at all. In the embodiment illustrated in FIGS. 1 to 2*c*, the swinging shaft 9 is in register with the axis of curvature of the grate 2 which has approximately sector-configuration when viewed from the front or in cross-section.

All of the features disclosed in the documents are claimed as being essential to the invention insofar as they are novel either individually or in combination with respect to the prior art.

I claim:

1. An apparatus for burning and/or thermally decomposing fuel, especially solid fuels such as peat, coal, wood, straw or refuse, said apparatus comprising:

means for supplying fuel to said apparatus;

a bar grate including a plurality of bars for supporting said fuel a material loosening means mounted adjacent said bar grate, said material loosening means including disks protruding between the grate bars and mounted on a common support shaft that extends perpendicular to the grate bars, said disks being mounted on said shaft at spaced locations along said shaft so that a clearance exists between adjacent disks;

means for causing relative movement between said bar grate and said material loosening means in the direction of said grate bars;

wherein said relative movement causes said material loosening means to act on said fuel to loosen said fuel.

2. An apparatus for burning and/or thermally decomposing fuel as claimed in claim 1 wherein said material loosening means is stationary and said grate is supported for reciprocating or swinging motion relative thereto.

3. An apparatus for burning and/or thermally decomposing fuel as claimed in claim 1 wherein said grate is of basket-like or disk-like configuration as viewed from the top.

4. An apparatus for burning and/or thermally decomposing fuel as claimed in claim 1 further comprising means for varying the intensity (frequency and/or amplitude) of relative reciprocating motion between said bar grate and said material loosening means for controlling combustion and/or thermal decomposition.

5. An apparatus for burning and/or thermally decomposing fuel as claimed in claim 1 wherein said disks of said material loosening means comprise knife-like cutting edges.

6. The apparatus for burning and/or thermally decomposing fuel of claim 1 further comprising means for supplying air or oxygen to said bar grate.

7. An apparatus for burning and/or thermally decomposing fuel of claim 1 wherein disks of said material loosening means comprise turning elements, especially turning blades, for revolving the fuel on said grate.

8. The apparatus for burning and/or thermally decomposing fuel of claim 1 wherein the grate bars extend continuously across the entire width of the bar grate in the direction of the relative movement between the disks and said bar grate, and wherein the relative movement between said bar grate and said disks is adapted to extend along the entire length of said grate bars.

9. A method of burning and/or thermally decomposing fuel, especially solid fuels such as peat, coal, wood, straw or refuse, comprising the steps of:

providing a bar grate including a plurality of bars for supporting solid fuel, said bar grate including disks protruding between the grate bars and mounted on a common support shaft that extends perpendicular to the grate bars for loosening material placed on the grate, said disks being mounted on said shaft at spaced locations along said shaft so that a clearance exists between adjacent disks;

supplying fuel to said bar grate;

causing relative movement between said bar grate and said disks in the direction of said grate bars to loosen and agitate the solid fuel placed on the grate.

* * * * *